US009921601B2

(12) United States Patent
Schnaitter et al.

(10) Patent No.: US 9,921,601 B2
(45) Date of Patent: Mar. 20, 2018

(54) FRACTIONAL BANDGAP CIRCUIT WITH LOW SUPPLY VOLTAGE AND LOW CURRENT

(71) Applicant: Ruizhang Technology Limited Company, Shanghai (CN)

(72) Inventors: William Schnaitter, San Ramon, CA (US); Steve Wang, San Jose, CA (US)

(73) Assignee: RUIZHANG TECHNOLOGY LIMITED COMPANY, Shanghai (CN)

( * ) Notice: Subject to any disclaimer, the term of this patent is extended or adjusted under 35 U.S.C. 154(b) by 0 days.

(21) Appl. No.: 14/845,244

(22) Filed: Sep. 3, 2015

(65) Prior Publication Data

US 2017/0060167 A1 Mar. 2, 2017

(30) Foreign Application Priority Data

Aug. 24, 2015 (CN) ..... 2015 1 0523798

(51) Int. Cl.
*G05F 3/26* (2006.01)

(52) U.S. Cl.
CPC ..... *G05F 3/267* (2013.01)

(58) Field of Classification Search
CPC . G05F 3/20; G05F 3/225; G05F 3/245; G05F 3/30; G05F 3/267
See application file for complete search history.

(56) References Cited

U.S. PATENT DOCUMENTS 3,697,923 A * 10/1972 Griffes ..... H01C 3/10 338/280
4,703,302 A * 10/1987 Hino ..... H01C 1/16 257/E27.047
5,304,978 A * 4/1994 Cummins ..... B60L 7/02 338/280
6,329,900 B1 * 12/2001 Everett ..... H01C 1/016 338/280
7,768,343 B1 8/2010 Sinitsky
2004/0008086 A1 * 1/2004 Sanchez ..... H03F 3/45192 330/260
2005/0218879 A1 * 10/2005 Garlapati ..... G05F 3/30 323/313
2005/0285666 A1 * 12/2005 Garlapati ..... G05F 3/267 327/539
2006/0087367 A1 * 4/2006 Inoue ..... G05F 3/205 327/543
2008/0144700 A1 * 6/2008 Schnaitter ..... G01K 7/01 374/178

(Continued)

FOREIGN PATENT DOCUMENTS

WO WO 2010/062285 A1 6/2010

OTHER PUBLICATIONS

European Search Report dated Jan. 10, 2017, for European Patent Application No. 16001859.4.

*Primary Examiner* — Yusef Ahmed

(74) *Attorney, Agent, or Firm* — Womble Bond Dickinson (US) LLP

(57) ABSTRACT

Disclosed is a fractional bandgap circuit and method to provide a same reference voltage value in a variety of circumstances of operation, including variations in manufacturing process, temperature, and a supply voltage. The disclosed fractional bandgap circuit and method also allows for low supply voltage operation within a compact layout area.

14 Claims, 10 Drawing Sheets

(56) References Cited

U.S. PATENT DOCUMENTS

| | | | | |
|---|---|---|---|---|
| 2008/0265860 | A1* | 10/2008 | Dempsey | G05F 3/30 323/314 |
| 2009/0015332 | A1* | 1/2009 | Oberhuber | H03F 1/30 330/261 |
| 2009/0051341 | A1 | 2/2009 | Chang et al. | |
| 2009/0110027 | A1* | 4/2009 | Chellappa | G01K 7/01 374/178 |
| 2009/0243713 | A1* | 10/2009 | Marinca | G05F 3/30 327/542 |
| 2010/0301832 | A1* | 12/2010 | Katyal | G05F 3/30 323/314 |
| 2014/0117966 | A1* | 5/2014 | Shaeffer | G05F 3/30 323/313 |
| 2014/0204548 | A1* | 7/2014 | Sekine | H05K 1/162 361/761 |
| 2015/0338872 | A1* | 11/2015 | Afzal | G05F 3/30 323/313 |

* cited by examiner

FRACTIONAL BANDGAP CIRCUIT WITH LOW SUPPLY VOLTAGE AND LOW CURRENT

This application claims priority under 35 U.S.C. § 119 to Chinese Patent Application No. 201510523798.2 filed on Aug. 24, 2015.

BACKGROUND INFORMATION

Low power, small size electronic components have benefits in a wide variety of consumer products. From radio-frequency identification (RFID) to mobile devices such as smartphones, manufacturers are constantly pursuing lower power consumption and smaller footprint designs for all of their electronic components.

One such component used in electronic devices is the bandgap reference circuit. Bandgap reference circuits are typically used to produce temperature independent reference voltages. Typical bandgap reference circuits may have supply requirements of at least 1.8 V. Attempts to provide designs to utilize less than 1.8V typically require three p-n junctions or the circuit may have three possible stable states. However, low power three p-n junction bandgap reference circuits are more expensive and complex to manufacture compared to higher power two p-n junction bandgap reference circuits. Therefore, manufacturers must make a tradeoff in design for power versus size and cost.

Additionally, a three-state design creates added complexity when designing and implementing a proper start-up circuit in comparison to start up circuits which may be used with a two state bandgap circuit design.

Therefore improved bandgap reference circuits are needed which can have low power usage as well as an efficient footprint.

BRIEF SUMMARY

Figure 1:
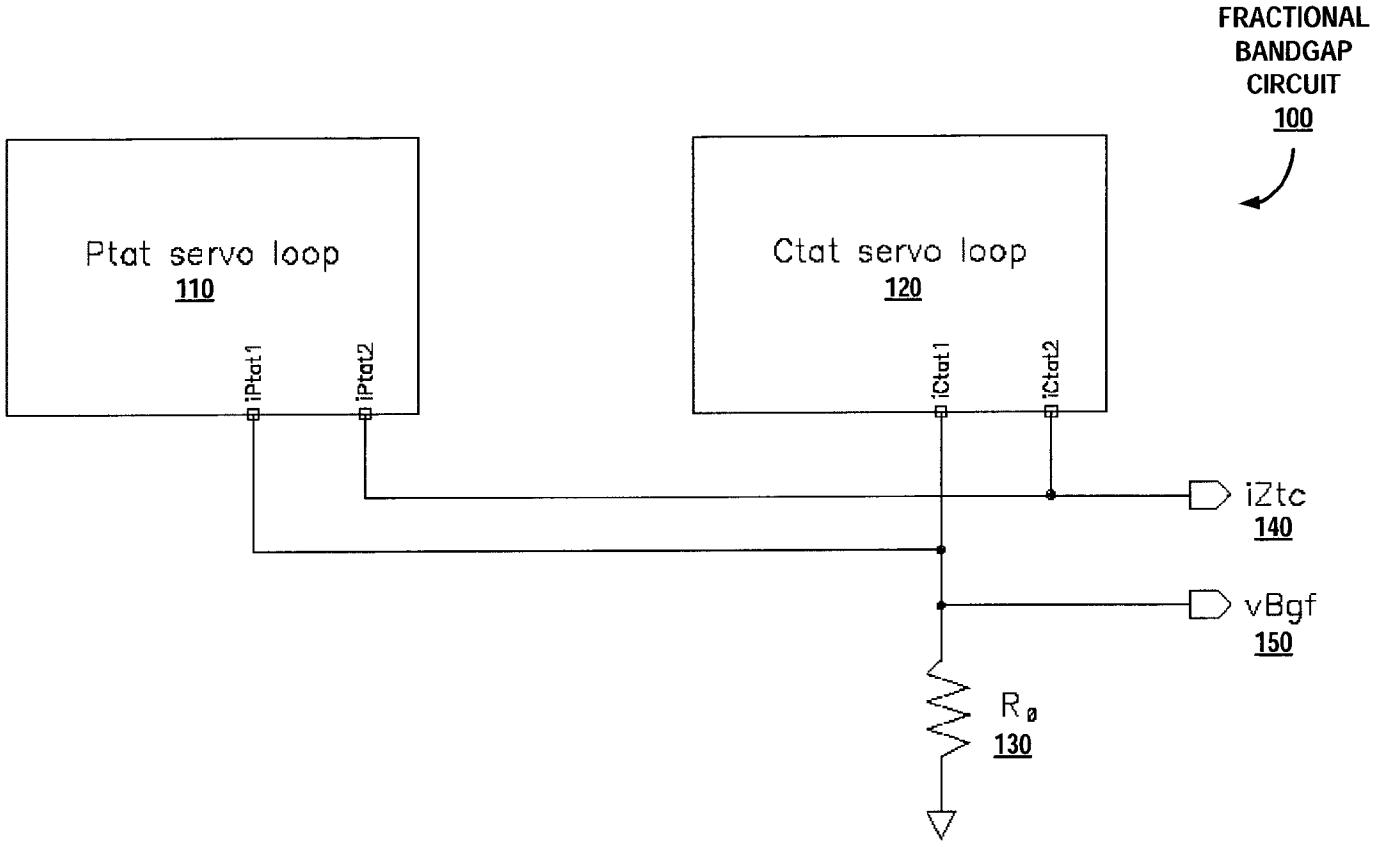
FIG. 1 is a block and circuit diagram of fractional bandgap circuit, in one embodiment.

In one embodiment, a reference voltage generating circuit includes a first servo loop (e.g., a PTAT servo loop) comprising a first p-n junction with a first current density and a second p-n junction with a second current density different than the first current density, a second servo loop (e.g., a CTAT servo loop) shares the first or the second p-n junction of the first servo loop, and a resistor coupled to the two servo loops and ground, wherein the voltage across the resistor is the reference voltage output.

In other embodiments, the reference voltage generating circuit includes a start-up circuit to ensure operation in a desired stable state and a gain-boost technique of current mirroring that achieves operation at a low supply voltage.

In another embodiment, the current from the PTAT servo loop and the current from the CTAT servo loop are combined in a configurable ratio, wherein the configurable ratio determines one or more of: a regulated temperature independent current, a canceling of temperature dependence of the resistor, or a regulated current source with a configurable temperature dependence.

In another embodiment, a method for provides a reference voltage. The method may include generating a first current with a first servo loop comprising a first p-n junction. The method may also include generating a second current with a second p-n junction, wherein a second servo loop is connected to one of the first or the second p-n junctions of the first servo loop. The method may also include outputting the reference voltage from a resistor coupled to the two servo loops and ground.

The above and other aspects, objects, and features of the present disclosure will become apparent from the following description of various embodiments, given in conjunction with the accompanying drawings.

DETAILED DESCRIPTION

The word "exemplary" or "example" is used herein to mean "serving as an example, instance, or illustration." Any aspect or embodiment described herein as "exemplary" or as an "example" is not necessarily to be construed as preferred or advantageous over other aspects or embodiments.

In one embodiment, a reference voltage generating circuit is described herein as a fractional bandgap circuit (referred to herein simply as "FBC") to provide a low-current, low-voltage, and temperature independent reference output. In one embodiment, the FBC implements two servo loops, a first of which produces a current that is proportional to absolute temperature (PTAT) and a second that produces a current that is complementary to absolute temperature (CTAT). The two servo loops may be combined with a resistor having a voltage independent of temperature. In one embodiment, the CTAT and PTAT are ratioed such that the temperature dependence of the voltage independent resistor is cancelled and the FBC has little to no temperature dependence.

In one embodiment, the FBC generates a first current PTAT with a first servo loop using two p-n junctions of differing current density. Unlike other bandgap circuit designs utilizing three p-n junctions, the FBC described herein utilizes two p-n junctions which saves area during manufacturing and can leverage lower cost wafer processing.

In one embodiment, a gain boost servo loop is connected with the PTAT servo loop to allow accurate mirroring at low supply voltage. In one embodiment, a third servo loop, without utilizing a third p-n junction, uses the voltage at one of the first two p-n junctions to generate a second current complementary to absolute temperature (CTAT). Current mirrors that replicate the internal current of the CTAT servo loop do not need a servo to allow accurate mirroring at low supply voltage. The mirrored PTAT and CTAT currents may be combined in a resistor to ground, to generate an output voltage that is a fixed fraction of the silicon bandgap voltage. In one embodiment, the output voltage is independent of process, temperature and supply voltage. Trimming techniques (e.g., with spare resistors or current mirrors, or both), may be added to allow trimming to a very accurate level if desired. Other trimming techniques known to those skilled in the art are also possible.

In some embodiments, the mirrored PTAT and CTAT currents are not equal and are opposite in temperature dependence. The output resistor of the FBC may have some known temperature dependence and the mirrored PTAT and CTAT currents that generate the fixed output reference voltage may be ratioed so that the temperature dependence of the combined currents accurately compensates for that of the output resistor. For example, if the temperature dependence of the output resistor were negative, the ratio of currents may be adjusted to compensate for that dependence by having additional PTAT current. The resulting fractional bandgap output voltage will be temperature-independent.

In some embodiments, two additional mirrored currents are summed to create a regulated, temperature-independent current. For example, by using two contributing currents of equal but opposite temperature coefficient. In some embodiments, the temperature-independent current is used with further mirroring to provide a regulated temperature-independent bias current utilized by the internal components of the design to maintain accurate performance and reliable circuit behavior. In addition, by still further mirroring, that current is used to generate and provide multiple regulated temperature-independent currents which may be used by other circuits outside the fractional bandgap.

In one embodiment, the CTAT current may be further mirrored to provide a regulated CTAT current source for an other circuit to use, to compensate for the PTAT dependence of those other circuits. In another embodiment, the PTAT current can be further mirrored to provide a regulated PTAT current source for use in other circuits, to compensate for the CTAT dependence of those other circuits. For example, a thermometer circuit may benefit from the regulated PTAT current source because a thermometer circuit may depend on the PTAT loop for the proportional to absolute temperature readings as well as the overall bandgap reference voltage.

In one embodiment, one mirrored PTAT current and one mirrored CTAT current may be ratioed as desired and combined to generate a current of any temperature-dependence, over a wide range, which may be needed for still other circuits. For example, a wide range might be −40 to 100° C. A "narrow" range of interest might be the temperature inside a meat storage unit where one wants to know the temperature, for example between −2 and +6° C., to an accuracy of 0.25° C. Other implementations or ranges are also possible within the scope of the embodiments described herein.

The FBC described herein may have two stable states, which enables use with a wide variety of two state compatible start-up circuits. In one embodiment, the FBC assumes either of two stable states, and a novel start-up circuit is provided to ensure that the circuit enters the desirable stable state. The start-up circuit can include a small capacitor and two transistors and may be manufactured with a low area low cost circuit. In one embodiment, FBC uses the described start-up circuit to initialize with zero current after startup. Further details of this start-up circuit are described below with regards to FIG. 7 below.

In one embodiment, a U-shaped resistor element layout technique achieves high resistance in small area by flipping resistor elements. As introduced above, minimizing the size of a circuit is highly beneficial for real world applications in electronic components. For bandgap circuits, resistors may take up a large percentage of the total area of the circuit. In one embodiment, the high density layout is achieved by using alternately-flipped "U-shaped" resistor elements to use minimum spacing across the length of the resistor. Further details of this resistor element layout are described below with regards to FIG. 9.

FIG. 1 is a block and circuit diagram of a fractional bandgap circuit, in one embodiment. As illustrated in FIG. 1, the FBC 100 uses two servo loops to generate a PTAT (i.e., a first servo loop 110) and a CTAT (i.e., a second servo loop 120) current, respectively. These currents may be mirrored at a desired ratio into a resistor, $R_0$ (e.g., resistor 130) to ground. The voltage across this resistor is the primary output voltage, vBgf 150. The FBC also generates similarly a temperature-independent current, iZtc 140.

The sum of the two currents into $R_0$ may not be independent of temperature. Rather, the two currents may be setup with a ratio to have a temperature-dependence complementary to that of $R_0$, a high-resistivity (e.g., 1000 Ω/sq. or other resistance) resistor (e.g., a poly-silicon resistor). On the other hand, the two currents summed to create iZtc, a temperature independent current, are of equal but opposite temperature coefficient. In some embodiments, $R_0$ is made up of many small identical resistor elements in series.

In one embodiment, the current from the PTAT servo loop and the current from the CTAT servo loop are combined in a configurable ratio. The configurable ratio determines (i.e., can be used to modify or affect) one or more of: a regulated temperature independent current, a canceling of temperature dependence of the resistor, or a regulated current source with a configurable temperature dependence.

Figure 2:
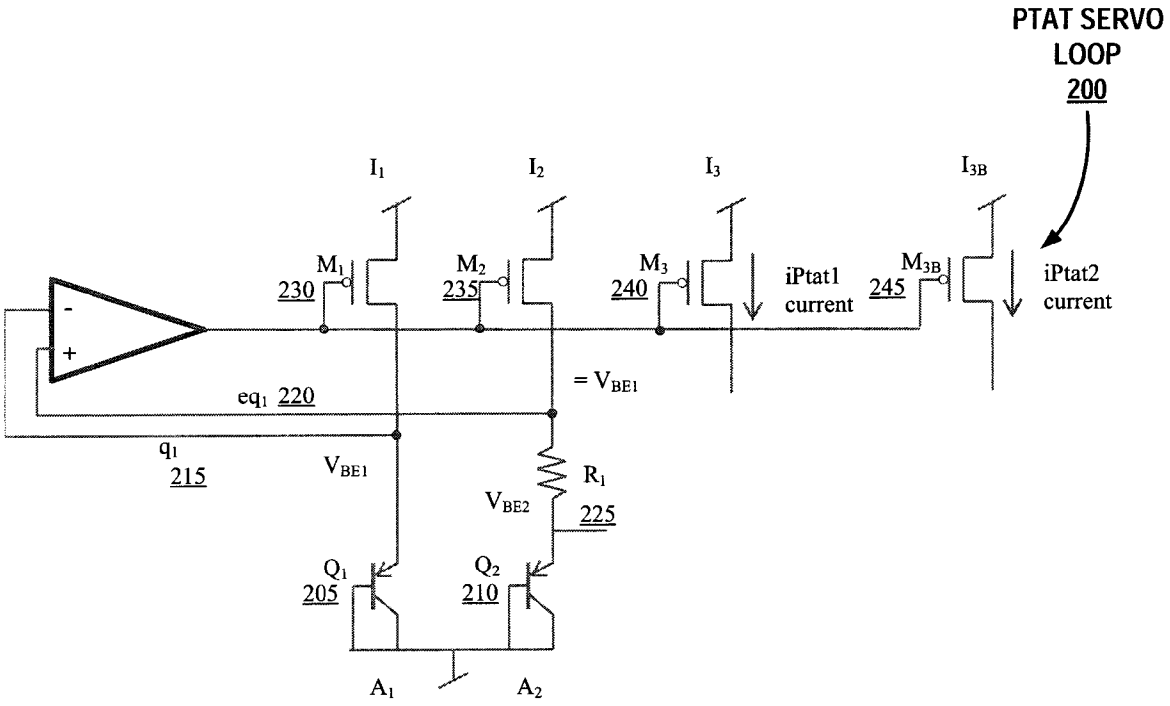
FIG. 2 is a block and circuit diagram of a proportional to absolute temperature (PTAT) servo loop, in one embodiment.

FIG. 2 is a block and circuit diagram of a PTAT servo loop, in one embodiment. In one embodiment, the PTAT servo loop 200 forces a ratioed pair of currents into a pair of unequal vertical PNP transistors (e.g., as illustrated by $Q_1$ 205 and $Q_2$ 210). These BJT's may be composed of common-centroided identical parallel small elements of a vertical PNP transistor cell: $b_1$ elements for $Q_1$ 205 the high-current-density device; and $b_2$ for $Q_2$ 210, the low-current-density device. The current sources into these are made up of pMos transistors with identical, common-centroided elements, m1 transistor elements for the current into $Q_1$ 205 and $m_2$ elements into $Q_2$ 210. Thus the ratio of current density is $(b_2/b_1)*(m_1/m_2)$. As used herein, this ratio is called "gamma," γ and is independent of process, temperature and supply voltage variations.

In one embodiment, the illustrated PTAT servo-loop adjusts elemental currents of $M_1$ and $M_2$ so that the voltage on the node $q_1$ 215 ($V_{BE1}$) is equal to the voltage on $eq_1$ 220, which is the voltage across the series combination of $R_1$ 225 and $Q_2$ 210. Thus the voltage across $R_1$ 225 is represented by $\Delta V_{BE}$, equal to the difference between the $V_{BE}$ voltages on $Q_1$ 205 and $Q_2$ 210. Given the Shockley relation:

$$J \propto \exp\left(\frac{qV_{BE}}{nkT}\right),$$

and the current density ratio γ, this voltage difference between $Q_1$ 205 and $Q_2$ 210 is:

$$\Delta V_{BE} = \frac{nkT}{q}\ln\gamma,$$

absolute temperature multiplied by a constant, and the resistor current is thus $(\Delta V_{BE})/R_1$, or $$I_{R1} = \frac{nkT}{R_1 q}\ln\gamma.$$

Thus me currents of the resistor and of the current sources are PTAT. Voltages $V_{BE1}$ and $V_{BE2}$ on $Q_1$ 205 and $Q_2$ 210 are CTAT, complementary to absolute temperature, given a PTAT current.

In one embodiment, $R_1$ 225 is made up of segments of identical resistor elements. The $R_1$ 225 resistor elements may be identical to, and common-centroided with, those elements in the main $R_0$ 130 resistor used for the vBgf output voltage 150.

In one embodiment, the currents through $M_1$ 230 and $M_2$ 235 are at a constant ratio of $m_1/m_2$. This ratio is very accurate when the loop is in regulation, since the drain voltages are then very nearly equal, along with the source, gate and body terminals being tied together. The currents are PTAT, since the $M_2$ 235 current equals the $R_1$ 225 current. In one embodiment, currents through $M_1$ 230 and $M_2$ 235 are mirrored in a fixed ratio through two additional transistors, $M_3$ 240 and $M_{3B}$ 245, to provide two PTAT currents from this module (e.g., as illustrated in FIG. 1). In one embodiment, transistors $M_3$ 240 and $M_{3B}$ 245 are also made up of elements identical to, and common-centroided with, those of $M_1$ 230 and $M_2$ 235.

Figure 3:
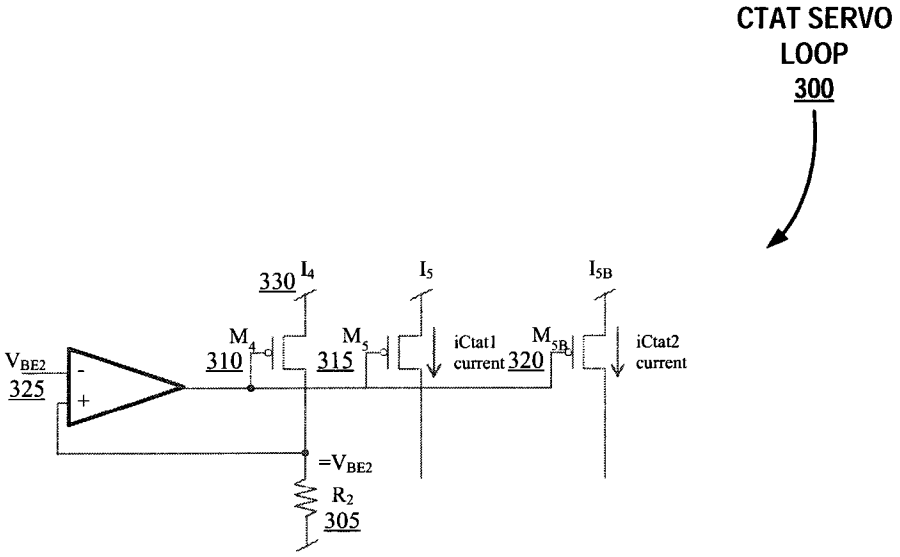
FIG. 3 is a block and circuit diagram of a complementary to absolute temperature (CTAT) servo loop, in one embodiment.

FIG. 3 is a block and circuit diagram of a CTAT servo loop, in one embodiment. In one embodiment, the CTAT servo loop 300 adjusts the current into another resistor, $R_2$, 305 to equate the resistor voltage on the $eq_2$ node ($V_{R2}$) to the $V_{BE2}$ on $Q_2$ generated in the PTAT servo loop 200. In one embodiment, $V_{BE2}$ is a CTAT voltage, so the current of the $R_2$ 305 resistor (and of $M_4$310) is CTAT.

In one embodiment, the $R_2$ 305 resistor illustrated in FIG. 3 is made up of segments of identical resistor elements in series, identical to and common-centroided with those elements in the $R_0$ 130 and $R_1$ 225 resistors of FIGS. 1 and 2 respectively. Thus the ratios between the resistors will remain as accurate constants. Because the servo loop equates the $R_2$ 305 voltage to $V_{BE2}$ 325, a CTAT voltage, the current, I4 330, through the resistor is CTAT, and so also through the transistor $M_4$ 310. In one embodiment, this current is mirrored in a fixed ratio through two additional transistors, $M_5$ 315 and $M_{5B}$ 320. In one embodiment, $M_5$ 315 and $M_{5B}$ 320 provide the two CTAT currents from this module shown in FIG. 1 (One more additional transistor, not shown, can provide an additional mirrored CTAT current, not shown in FIG. 1, from the CTAT servo loop directly to another integrated circuit outside the FBC.)

Figure 4:
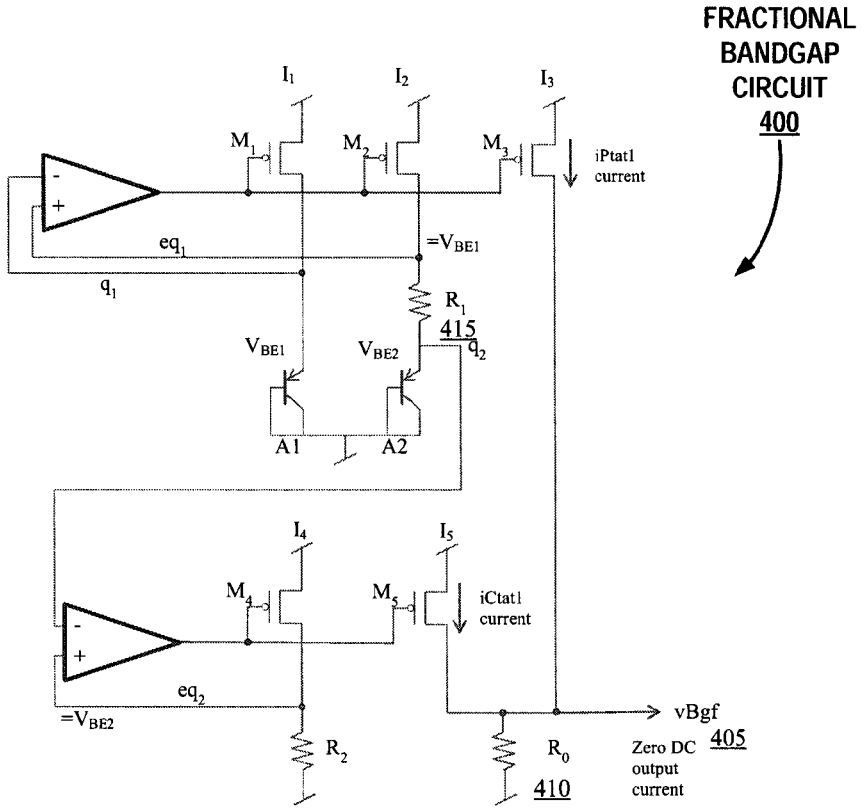
FIG. 4 is a block and circuit diagram of fractional bandgap circuit, in another embodiment.

FIG. 4 is a block and circuit diagram of fractional bandgap circuit, in another embodiment. As illustrated in FIG. 4, the fractional bandgap circuit 400 includes both the CTAT and PTAT servo loops. From the simplified overall diagram illustrated in FIG. 4, the equation for the bandgap output voltage may be derived from:

$$V_{R1} = I_2 R_1 = V_{BE1} - V_{BE2} = \Delta V_{BE}$$

-continued $$I_3 = A \cdot I_2 \quad I_4 = \frac{V_{BE2}}{R_2} \quad I_5 = B \cdot I_4$$

$$A \equiv \frac{M_3}{M_2} \quad B \equiv \frac{M_5}{M_4}$$

$$I_3 = A \cdot \frac{\Delta V_{BE}}{R_1} \quad I_5 = B \cdot \frac{V_{BE2}}{R_2}$$

$$vBgf = R_0 \cdot (I_5 + I_3)$$

$$vBgf = B \cdot \frac{R_0}{R_2}\left(V_{BE2} + \frac{A \cdot R_2}{B \cdot R_1}\Delta V_{BE}\right)$$

The expression $$V_{BE2} + \frac{A \cdot R_2}{B \cdot R_1}\Delta V_{BE}$$

is a full bandgap expression that is unaffected by the choice of $R_0$. The values for A, B, $R_2$ and $R_1$ are such that the total voltage in $$V_{BE2} + \frac{A \cdot R_2}{B \cdot R_1}\Delta V_{BE}$$

is temperature independent. In one embodiment, the final value of the fractional bandgap output is a fixed fraction of a full bandgap voltage.

In one embodiment, the magnitude of vBgf 405 may be configured according to the number of resistor elements that make up $R_0$ 410. For example, the value of vBgf may be configured by tapping off the output from the $R_0$ 410 resistor stack (e.g., with additional optional resistor elements) by an analog mux or by metal options (e.g., the amount or configuration of the metal composition) in an integrated circuit fabrication mask. For example, if the FBC is configured to produce a fractional bandgap voltage of around 365 mV, equally valid fractional bandgap voltages may be created by tapping off the resistor $R_0$ 410.

In one embodiment, the $R_0$ 410 resistor used to determine the final magnitude of the fractional bandgap output (e.g., as illustrated in FIG. 4), may be a stack of resistor elements in series to allow accurate ratio'ing and common-centroiding. In some embodiments, a basic fractional bandgap output of 0.36 V is obtained with 30 resistor elements in $R_0$. However, other additional voltages may be output by tapping off the $R_0$ stack below the top and adjusting the number of resistor elements. The alternate number of resistor elements can provide other/configurable fractional bandgap output voltages. As illustrated in FIG. 4, the $R_1$ 415 resistor in the PTAT servo loop has the delta $V_{BE}$ PTAT voltage, which is not temperature independent.

Figure 5:
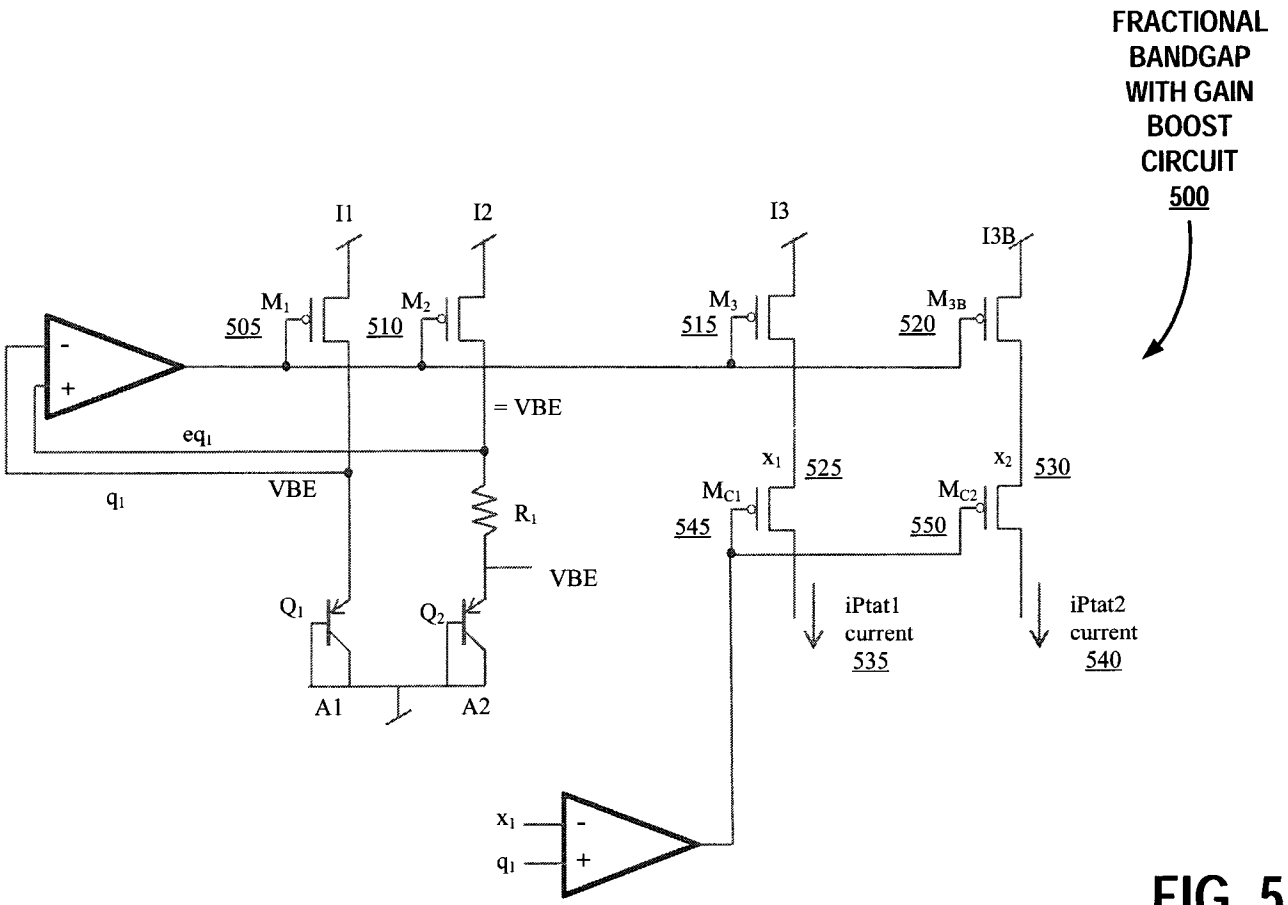
FIG. 5 is a block and circuit diagram of a PTAT servo loop with gain boost, in one embodiment.

FIG. 5 is a block and circuit diagram of a PTAT servo loop with gain boost, in one embodiment. As an illustrated example of one possible configuration of the FBC of FIG. 5 a minimum supply voltage of approximately 0.68V and a supply current of approximately 190 nA may produce a variation over temperature, supply and process of approximately 5%. The output voltage of this example configuration will be approximately 365 mV and the resulting FBC design may utilize an area of about 6500 $\mu m^2$. At low temperature, the PTAT servo loop forward $V_{BE1}$ voltage (a CTAT voltage) across $Q_1$ may rise to around 680 mV. Thus, as the supply voltage falls to around 700 mV, the current from $M_3$ 515 of the PTAT servo loop, mirroring from $M_1$ 505 and $M_2$ 510, may become inaccurate. The supply voltage, minus a small overhead voltage needed by $M_1$ 505, would approach $V_{BE1}$. One reason for the inaccuracy of the mirroring is that the drain-to-source voltage of $M_3$ 515 (and $M_{3B}$ 520) may be much greater than that of $M_1$ 505 and $M_2$ 510. In some embodiments, as illustrated in FIG. 5 a "gain-boost" type loop was added to the circuitry of the PTAT servo loop to improve accuracy of the FBC.

The gain-boost loop illustrated in FIG. 5 may control the gates of cascode transistors added in series to the $M_3$ 515 and $M_{3B}$ 520 output transistors. The gate bias of the cascode transistors affects the VDS of $M_3$ 515 and $M_{3B}$ 520. In one embodiment, servoing the gate bias so that the voltage with respect to vdda at node $x_1$ 525 is matched to the voltage with respect to vdda at node $q_1$, enables all terminals of $M_3$ 515 to match those of $M_1$ 505 and the currents will be equal, increasing overall circuit accuracy. The voltage at node $x_2$ 530 should be close to that at $x_1$ 525 and the accuracy of the iPtat2 output 540 is not as critical. Thus, only one servo loop is used. However, in another embodiment, another servo loop could similarly servo the gate of $M_{C2}$ 550 such that the voltage at node $x_2$ 530 is equal to the voltage at node $x_1$ 525.

In yet other embodiments, a similar gain boost mechanism is added to the CTAT servo loop, however the accuracy is not as affected at some voltages (e.g., around 700 mV) compared to the PTAT servo loop because the drain/source voltage of $M_4$ 310 will not be nearly as low as for $M_1$ 230 and $M_2$ 235. Therefore, $q_2$ may be used as the reference for the CTAT servo loop rather than $q_1$, which would be a higher voltage. Additionally, a higher reference voltage would require a combination of a larger $R_2$ or greater resistor current, neither of which is to be desired. Accordingly, in some embodiments, the lower $q_2$ voltage is utilized as the preferred reference for the CTAT servo loop. As an illustrated example using the example characteristics introduced for the FBC of FIG. 5, at −40° C., $q_2$ voltage may be about (680 mV−(nkT/q)ln γ, or approximately 613 mV.

Figure 6:
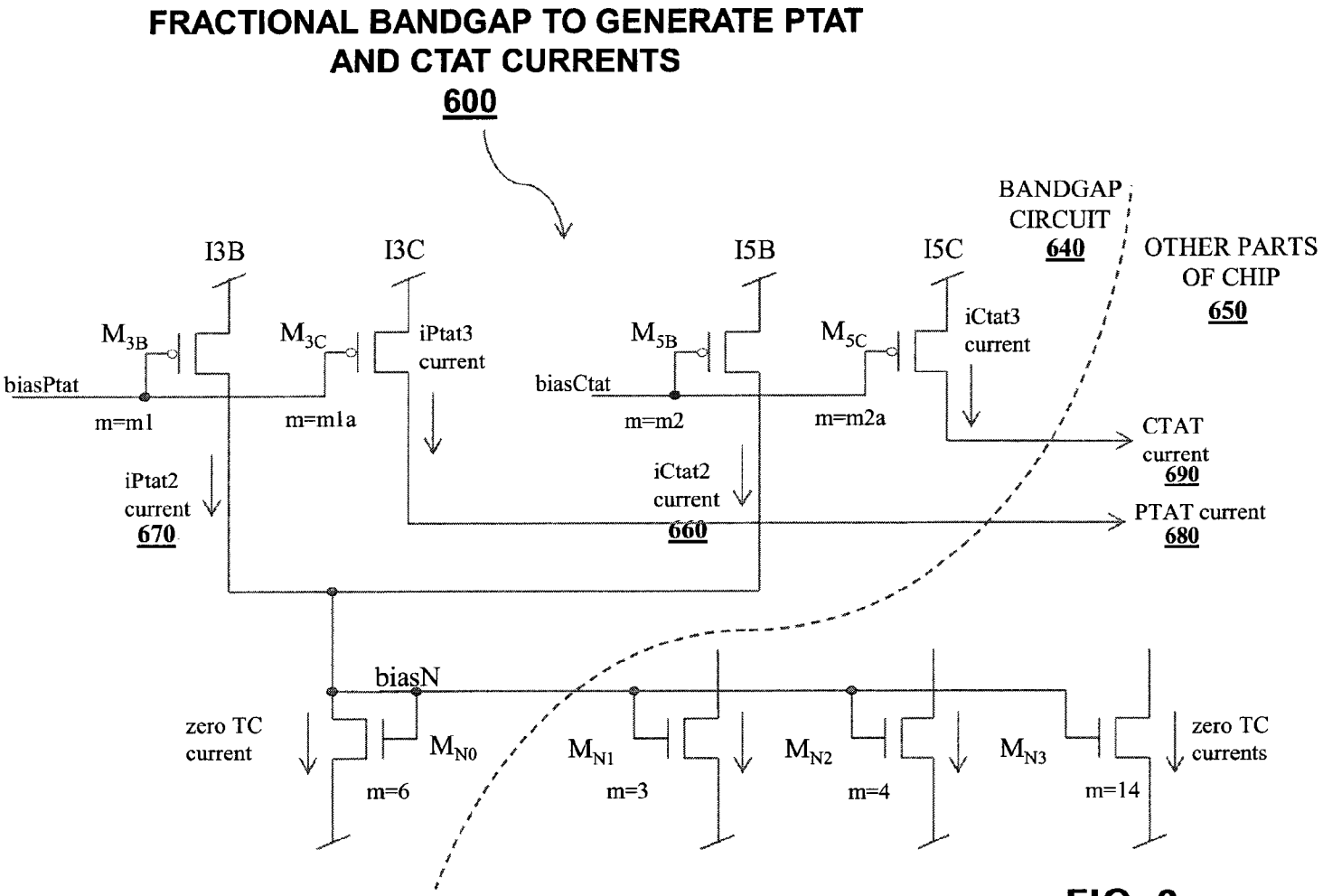
FIG. 6 is a block and circuit diagram to generate currents with various temperature dependence, for use in other circuits outside the bandgap circuit, in one embodiment.

FIG. 6 is a block and circuit diagram to generate currents with various temperature dependence, for use in other circuits outside the bandgap circuit, in one embodiment. In one embodiment, by combining a ratioed PTAT current 670 with a ratioed CTAT current 660 from the bandgap circuit 640, a "zero-TC" current with zero temperature dependence is generated. This current may flow into a diode-connected nMos transistor, $M_{N0}$. The gate voltage of $M_{N0}$ is termed "biasN" and will be at a voltage level consistent with the drain current. This gate voltage can be used in current mirroring to $M_{N1}$, $M_{N2}$, $M_{N3}$, etc., with various "m" counts, to generate multiple temperature-independent currents for use in other circuits. The $M_{Ni}$ mirror transistors can be co-located, even commonly-centroided, with $M_{N0}$, with the output currents bussed to the other circuits, for better accuracy.

Also, other currents can be generated that are proportional to absolute temperature, as by $M_{3C}$, or complementary to absolute temperature, as by $M_{5C}$, for use in other circuits on the same chip, which may need such currents for temperature compensation or other purposes.

In one embodiment, adding another PTAT transistor, for example $M_{3C}$, with biasPtat on the gate, will create the PTAT current 680 from bandgap circuit 640. Such a PTAT current could simply go through a resistor to ground. Since the current is simply a multiple of $I_2$ (i.e., $I_2$ of FIG. 2) and the resistor can be made up of the same elements as $R_1$ (i.e., $R_1$ of FIG. 2), the voltage with respect to ground across this resistor is proportional to absolute temperature and can form the input to an A-to-D converter with the output being a digital expression of the absolute temperature.

Figure 7:
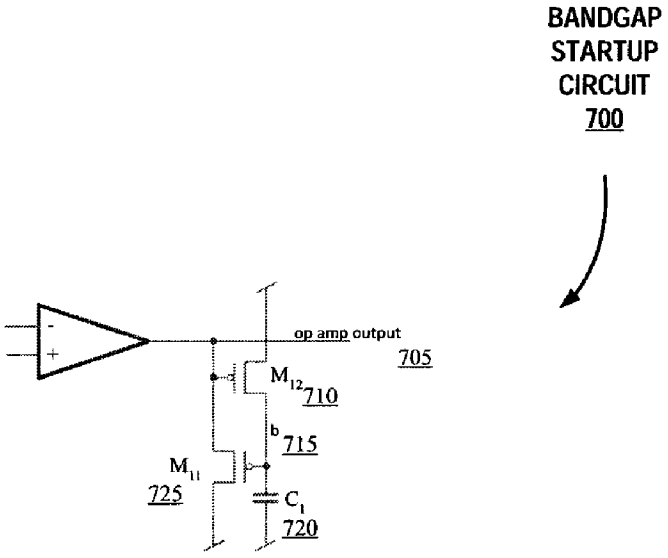
FIG. 7 is a block and circuit diagram of start up circuit, in one embodiment.

FIG. 7 is a block and circuit diagram of start up circuit, in one embodiment. As described herein with reference to the FBC, there are two possible stable points of operation. The undesirable stable state is where the op amp outputs are at the vdda rail and no current is produced by the current sources so the op amp inputs are at the ground rail. In both PTAT and CTAT servo loops, the op amp output 705 (e.g., a differential op amp) initially tracks vdda as it rises. The start up circuit 700 of FIG. 7 is designed to pull the op amp output in the PTAT servo loop down from vdda during power-up until the current, in a transistor $M_{12}$ 710 similar to the loop current-sources, is sufficient to pull the voltage on the "b" node 715 up to turn off this start up current. When the voltage on the "b" node 715 is pulled up, the loop current-sources will have become strong enough to bring the loop up to the desired stability point. The capacitor, $C_1$ 720, helps ensure that the node "b" 715 is close to ground during any power-up. As the current in $M_{12}$ 710 rises, along with the servo-loop current sources, $C_1$ 720 is charged to the supply voltage and $M_{11}$ 725 (e.g., a PMOS transistor) will be guaranteed to be off. When the power supply voltage is high enough to get current out of PTAT servo loop's $I_1$, $I_2$, and $I_3$, then $M_{12}$ 710 will also have current because the op amp output is being pulled down to turn on $I_1$, $I_2$, and $I_3$. The start up circuit will turn on $M_{12}$ 710 which pulls the node "b" 715 up to Vdd, while shutting down $M_{11}$ 725 after the startup. Therefore, the startup circuit current after startup may be considered zero. In one embodiment, the start up circuit 700 of FIG. 7 is considered complete and functional for integration with the FBC with just the three startup components: two transistors (e.g., $M_{11}$ 725, $M_{12}$ 710), and a single capacitor (e.g., capacitor $C_1$ 720). Furthermore, during fabrication/manufacture the single capacitor $C_1$ 720 may be physically coupled to the top of $M_{11}$ 725 and $M_{12}$ 710 such that the capacitor $C_1$ 720 takes little to no surface area on its own.

In one embodiment, the startup circuit is implemented for the $q_1$ and $eq_1$ of the PTAT servo loop 200. For example, startup circuit 700 may be coupled to the upper op amp of FIG. 4. In comparison to the PTAT servo loop 200, the CTAT servo loop 300 is guaranteed to startup correctly as long as the q2 input starts up correctly, therefore the CTAT servo loop may be implemented without a startup circuit. The startup circuit will guarantee the PTAT servo loop starts up correctly at the correct stable point of the two stable points.

In one embodiment, the FBC with startup circuit utilizes a bias current for the op amps. For example, the FBC itself may be used to generate this bias current. The startup circuit provides the initial bias current by pulling down the gates of the current sources in the two loops, as discussed above. Thus those sources will provide initial current to the biasN node (and to the diode-connected nMos transistor). Once the bandgap circuit stabilizes, including both the PTAT and CTAT servo loops, the biasN node is at a stable voltage and the needed bias currents will thus be generated in the op amps.

It should be noted that this provision for the bias currents just described constitutes a feedback loop itself in the bandgap circuit as a whole. This added loop (and all feedback loops in the bandgap circuit) should be ensured to be stable as usual, as is understood by those practiced in the art.

Figure 8:
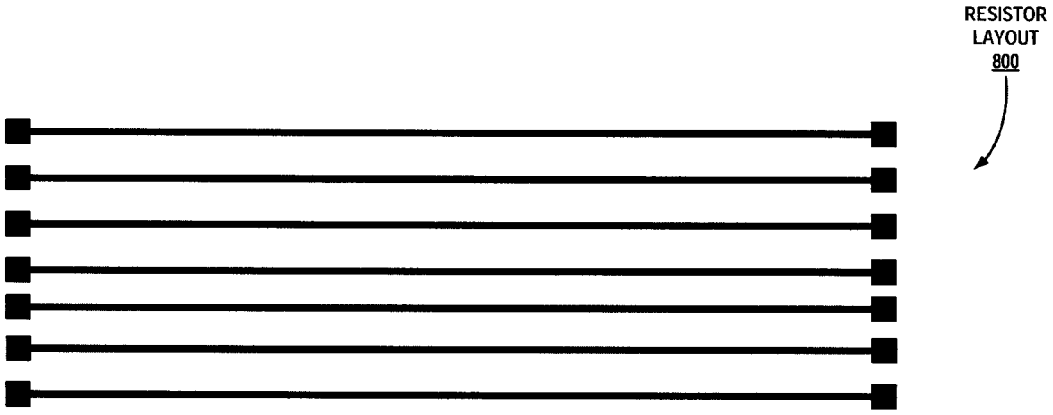
FIG. 8 is diagram illustrating a traditional resistor layout design.

FIG. 8 is a traditional resistor element layout diagram. As illustrated, the poly-silicon resistor elements 800 are simply long narrow lines with a contact at each end. For example, the line width may be 0.6 um or larger. As an example of a traditional design, the poly spacing may be forced to a minimum of 0.34 um, compared to the design rule for poly spacing, which is only 0.25 um. With these example characteristics, the total resistance/unit area is only about 1.675 kΩ/um$^2$.

Figure 9:
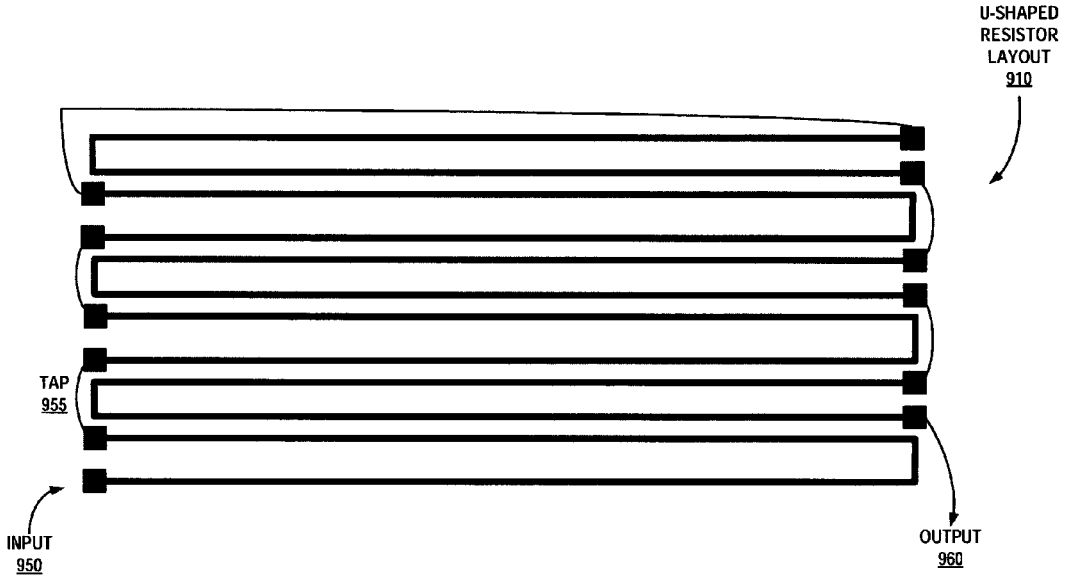
FIG. 9 is a diagram illustrating a U-shaped resistor element layout design, in one embodiment.

FIG. 9 is a flipped U-shaped resistor element layout diagram, in one embodiment. In one embodiment, the FBC described herein utilizes very small currents and therefore very large resistors are required to achieve the voltages in the hundreds of mV. For example, a resistor voltage of 350 mV, with a current of only 35 nA requires a resistance of 10 Ma With $\rho_s$ at 1000 Ω/sq, and a recommended line width of 2 um and minimum spacing of 0.25 um, the area of such a 10 MΩ resistor may be greater than 42.5 k um$^2$. In some embodiments, resistors $R_1$, $R_2$, and $R_0$ in the illustrated examples of FIG. 1-5 may total 29.23 MΩ or greater with spares, and may total over 124 k um$^2$. This may be too large an area for practical application and may be many times the area budget for the entire bandgap circuit.

The FBC resistors may use many elements to allow common-centroiding, and reasonable resolution for choosing values for the desired resistor ratios. The resistor element size may be determined as a small fraction of the total resistance of any of the three main resistors discussed above (e.g., $R_1$, $R_2$, and $R_0$). The layout of the resistor element of FIG. 9 is a flipped U-shaped configuration and resistor layouts can leverage the compact physical arrangement in alternating orientation, as illustrated. In one embodiment, this U-shaped resistor element design allows the full length of the element to use minimum spacing and reduces the overhead of the end contacts to a small percentage of overall area.

In one embodiment, the resistor may be connected to the FBC at input 950 and continue with a tap 955 to bring the two resistor elements together. The resistor elements of FIG. 9 may be connected together through a final resistor element and output 960. In some embodiments, FIG. 9 is a single resistor, however multiple instances of the resistor of FIG. 9 may be combined, for example in a common centroid pattern as discussed below. In one embodiment, to get the voltage of the FBC correct, the currents are matched to the FBC resistor by centroiding. For example, as illustrated in FIG. 4, $R_1$, $R_2$, and $R_0$ may be arranged in a centroid design with a common array of resistor elements.

The technique used in traditional large resister designs results in a density of 1.68 kΩ/um$^2$. In that layout, a poly line-width of 0.6 um was used. Also the layout technique required spacing of 0.34 um, vs. a minimum spacing allowed of 0.25 um. Pushed to the same narrow poly line-width of 0.24 um, one can get 6.71 kΩ/um$^2$. Compared with the example resistor layout of FIG. 9 having total resistance/unit area is about 1.675 kΩ/um$^2$ the flipped u-shaped resistor element can achieve 11.4 kΩ/um$^2$ or greater total resistance/unit area. Therefore, a large resistor with this U-shaped design can take up far less real estate on the silicon. As another illustrated example, the total area of the resistors in the FBC illustrated in FIG. 1 may be about 2800 um$^2$.

In one embodiment, the resistors in the FBC may be laid out in a common-centroid arrangement of numerous smaller resistor elements to maintain maximum matching accuracy in the resistor ratios. For example, three resistors, $R_0$, $R_1$, and $R_2$ may be arranged in a sequence of: [$R_0$ $R_1$ $R_2$ $R_0$ $R_1$ $R_1$ $R_0$ $R_2$ $R_1$ $R_0$], where the four $R_0$ elements would be connected in series, with the geometric center of them in the center of the arrangement. The four $R_1$ elements above would also be connected in series, with the geometric center of them also in the center of the arrangement. The two $R_2$ elements above would be connected in series, with the geometric center of them also in the center of the arrangement. The ratio of the resistance of this example common-centroid arrangement above $R_0$:$R_1$:$R_2$ would be 2:2:1. A common-centroid arrangement may guard against a linear variation in the resistor value as a function of position. This variation would average out with a presumption that the metal connecting the resistor elements is of negligible resistance.

Figure 10:
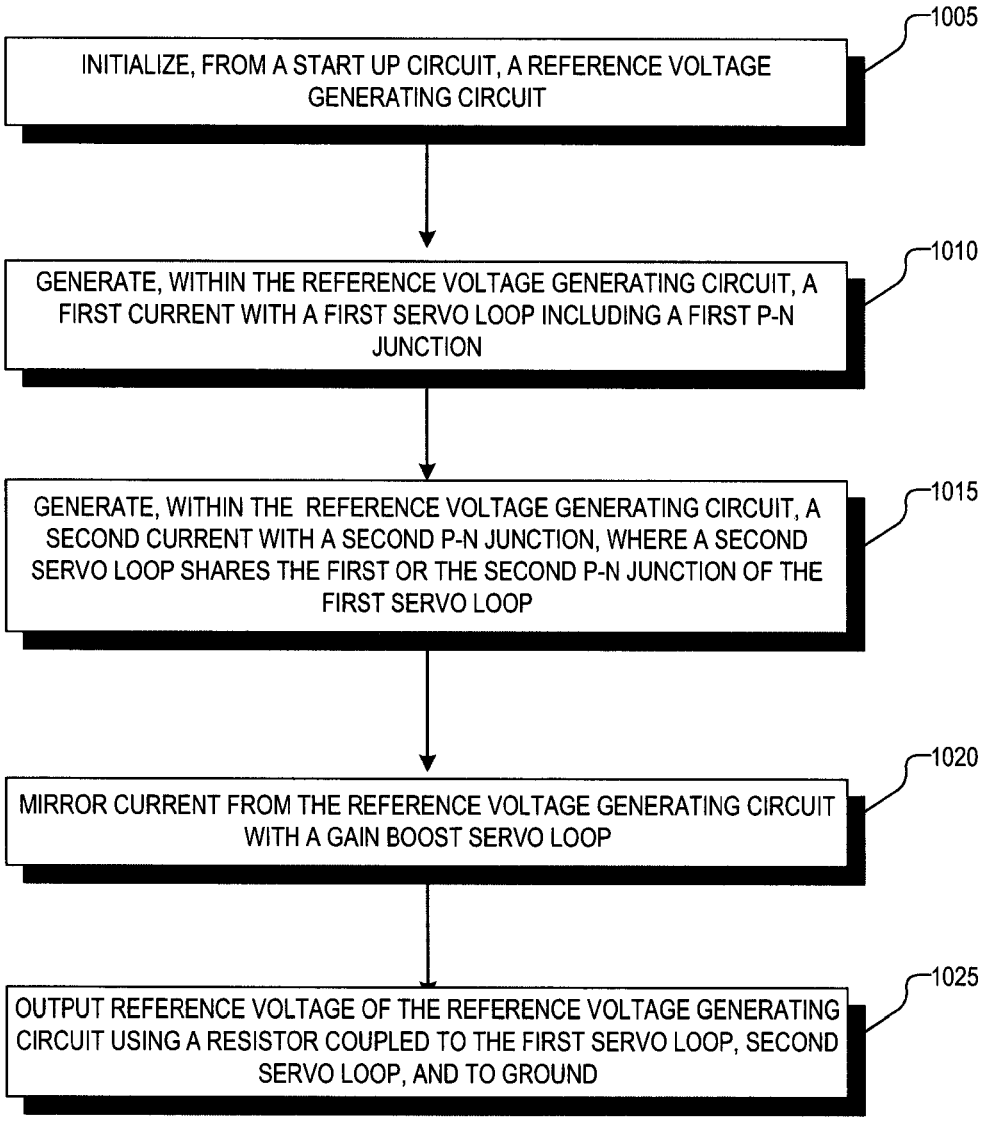
FIG. 10 illustrates a flow diagram of a method to generate a reference voltage, in one embodiment.

FIG. 10 illustrates a flow diagram of a method to generate a reference voltage, in one embodiment. At block 1005, the embodiment (e.g., a method for generating reference voltage implemented by a circuit such as the circuit including the FBC described herein), initializes, from a start up circuit (e.g., circuit 700), a reference voltage generating circuit (e.g., the FBC 100).

At block 1010, the embodiment generates, within the reference voltage generating circuit, a first current with a first servo loop including a first p-n junction. For example, the first servo loop may be a PTAT servo loop (e.g., PTAT servo loop 110).

At block 1015, the embodiment generates, within the reference voltage generating circuit, a second current with a second p-n junction, where a second servo loop shares the first or the second p-n junction of the first servo loop. For example, the second servo loop may be a CTAT servo loop (e.g., CTAT servo loop 120).

At block 1020, the embodiment mirrors current from the reference voltage generating circuit with a gain boost servo loop. For example, the gain boost servo loop as illustrated in FIG. 5.

At block 1025, the embodiment outputs reference voltage of the reference voltage generating circuit using a resistor coupled to the first servo loop, second servo loop, and to ground. In some embodiments, the voltage is determined according to metal composition of the resistor, or an analog mux.

The foregoing discussion merely describes some exemplary embodiments of the present invention. One skilled in the art will readily recognize from such discussion, the accompanying drawings and the claims that various modifications can be made without departing from the spirit and scope of the invention.

Additionally, in the above drawings of the embodiments, signals may be represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct electrical connection between the things that are connected, without any intermediary devices. The term "coupled" means either a direct electrical connection between the things that are connected, or an indirect connection through one or more passive or active intermediary devices. The term "circuit" means one or more passive and/or active components that are arranged to cooperate with one another to provide a desired function. The term "signal" means at least one current signal, voltage signal or data/clock signal. The meaning of "a", "an", and "the" include plural references. The meaning of "in" includes "in" and "on".

As used herein, unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner. The term "substantially" herein refers to being within 10% of the target.

For purposes of the embodiments described herein, unless otherwise specified, the transistors are metal oxide semiconductor (MOS) transistors, which include drain, source, gate, and bulk terminals. Source and drain terminals may be identical terminals and are interchangeably used herein. Those skilled in the art will appreciate that other transistors, for example, Bi-polar junction transistors—BJT PNP/NPN, BiCMOS, CMOS, etc., may be used without departing from the scope of the disclosure.

What is claimed is:

1. A reference voltage generating circuit comprising:

a first servo loop comprising a first p-n junction with a first current density and a second p-n junction with a second current density different than the first current density, the first p-n junction providing a first voltage, the first servo loop outputting a first proportional to absolute temperature (PTAT) current and a second PTAT current;

a second servo loop to receive the first voltage provided at the first p-n junction of the first servo loop to output a first complementary to absolute temperature (CTAT) current; and a resistor coupled to ground and to the first servo loop to receive the first PTAT current, wherein the resistor is coupled to the second servo loop to receive the first CTAT current, wherein a voltage across the resistor is a reference voltage output, wherein the first servo loop is a PTAT servo loop and the second servo loop is a CTAT servo loop, wherein the second servo loop is to output a second CTAT current, wherein the first PTAT current and the first CTAT current are combined to generate a first output current having a temperature dependence according to a configurable ratio, and wherein the second CTAT current and the second PTAT current are combined to generate a second output current that is temperature independent.

2. The reference voltage generating circuit of claim 1, further comprising:

a regulated CTAT current source coupled to the second servo loop and an other circuit to compensate for a PTAT dependence of the other circuit.

3. The reference voltage generating circuit of claim 1, further comprising:

a regulated PTAT current source coupled to the first servo loop and an other circuit to compensate for a CTAT dependence of the other circuit.

4. The reference voltage generating circuit of claim 1, wherein the reference voltage output is determined by metal composition of the resistor, or an analog mux.

5. The reference voltage generating circuit of claim 1, further comprising a start-up circuit coupled to the first servo loop, the start-up circuit comprising:

a single capacitor; and two transistors coupled to the single capacitor.

6. The reference voltage generating circuit of claim 1, further comprising:

a gain boost servo loop with current mirroring coupled to the first servo loop to increase output accuracy.

7. The reference voltage generating circuit of claim 1, wherein the resistor comprises a plurality of resistors arranged in a flipped U-shaped configuration.

8. A method for providing a reference voltage, the method comprising:

generating a first proportional to absolute temperature (PTAT) current and a second PTAT current using a first servo loop comprising a first p-n junction and a second p-n junction; the first p-n junction providing a first voltage;

generating a first complementary to absolute temperature (CTAT) current using a second servo loop, the second servo loop receiving the first voltage provided at the first p-n junction of the first servo loop to output the first CTAT current, wherein the first servo loop is a PTAT servo loop and the second servo loop is a CTAT servo loop, and wherein the second servo loop is to output a second CTAT current;

outputting the reference voltage from a resistor coupled to the first servo loop, the second servo loop, and to ground, wherein the resistor is coupled to the first servo loop to receive the first PTAT current and wherein the resistor is coupled to the second servo loop to receive the first CTAT current; and combining the first PTAT current and the first CTAT current to generate a first output current having a temperature dependence according to a configurable ratio, wherein the second CTAT current and the second PTAT current are combined to generate a second output current that is temperature independent.

9. The method of claim 8, further comprising:

connecting a regulated CTAT current source to the second servo loop and an other circuit to compensate for a PTAT dependence of the other circuit.

10. The method of claim 8, further comprising:

connecting a regulated PTAT current source to the first servo loop and an other circuit to compensate for a CTAT dependence of the other circuit.

11. The method of claim 8, further comprising:

determining the reference voltage output according to a metal composition of the resistor, or an analog mux.

12. The method of claim 8, further comprising:

initializing from a start-up circuit coupled to the first servo loop, the start-up circuit comprising a single capacitor and two transistors coupled to the single capacitor.

13. The method of claim 8, further comprising:

mirroring current with a gain boost servo loop coupled to the first servo loop to increase output accuracy.

14. The method of claim 8, wherein the resistor comprises a plurality of resistors arranged in a flipped U-shaped configuration.

* * * * *